US007438596B2

(12) United States Patent
Phillips

(10) Patent No.: US 7,438,596 B2
(45) Date of Patent: Oct. 21, 2008

(54) ELECTRICAL CONNECTOR ASSEMBLY WITH EMI GASKET

(75) Inventor: Michael J. Phillips, Camp Hill, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/653,720

(22) Filed: Jan. 12, 2007

(65) Prior Publication Data

US 2008/0171469 A1 Jul. 17, 2008

(51) Int. Cl.
*H01R 13/648* (2006.01)

(52) U.S. Cl. ..... 439/607; 439/927

(58) Field of Classification Search ..... 439/607, 439/927; 174/355, 356
See application file for complete search history.

(56) References Cited

U.S. PATENT DOCUMENTS

| | | | | |
|---|---|---|---|---|
| 4,864,076 | A * | 9/1989 | Stickney | 174/355 |
| 5,766,041 | A | 6/1998 | Morin et al. | |
| 6,095,862 | A | 8/2000 | Doye et al. | |
| 6,478,622 | B1 * | 11/2002 | Hwang | 439/607 |
| 7,001,217 | B2 | 2/2006 | Bright et al. | |
| 7,070,446 | B2 | 7/2006 | Henry et al. | |

* cited by examiner

*Primary Examiner*—Ross N Gushi

(57) ABSTRACT

An electrical connector assembly includes a cage member configured for mounting in an opening in a panel. The cage member has at least one compartment for receiving a pluggable electrical component therein. An EMI gasket is mounted externally on the cage member. The EMI gasket includes a dielectric carrier holding a plurality of electrically conductive springs that are configured to engage the panel when the cage member is mounted in the opening in the panel.

16 Claims, 9 Drawing Sheets

ELECTRICAL CONNECTOR ASSEMBLY WITH EMI GASKET

BACKGROUND OF THE INVENTION

The invention relates generally to electrical connector assemblies, and more particularly, to electrical connector assemblies for pluggable electronic modules.

Some known electrical connector assemblies include a metal cage having a plurality of ports the each receive a small form factor pluggable (SFP) module therein. The pluggable modules may plug into an electrical connector that is held within the cage and is electronically connected to a host circuit board. An end of the cage that includes the ports for the pluggable modules is typically held within a panel of a housing that contains the host circuit board therein. For example, the housing may be a housing for a computer that includes the host circuit board. The end of the cage that is held within the panel typically includes a plurality of springs formed integrally from a wall thereof. The springs extend circumferentially about the end of the cage and exert a spring force on an interior surface of the panel opening that receives the cage end to securely hold the cage end within the panel opening. The springs also facilitate containing electromagnetic interference (EMI) emissions by providing a plurality of contact points that ground the cage to the panel.

However, maintaining a predetermined structural integrity of the cage at the end held within the panel opening limits the number of springs that can be formed from the cage wall. Accordingly, maintaining the predetermined structural integrity may limit the number of contact points that facilitate the containment of EMI emissions. Specifically, if the cage wall is formed with too many springs, the structural integrity of the cage wall at the end held within the panel opening may fall below design limits, thereby leading to instability and possible deformation of the cage. Therefore, the springs must be spaced far enough apart along the circumference of the cage wall such that the structural integrity of the cage wall at the end held within the panel opening does not fall below design limits.

There is a need for an electrical connector assembly that includes a cage that facilitates minimizing EMI emissions while maintaining a predetermined structural integrity of the cage.

BRIEF DESCRIPTION OF THE INVENTION

In one aspect, an electrical connector assembly is provided. The electrical connector assembly includes a cage member configured for mounting in an opening in a panel. The cage member has at least one compartment for receiving a pluggable electrical component therein. An EMI gasket is mounted externally on the cage member. The EMI gasket includes a dielectric carrier holding a plurality of electrically conductive springs that are configured to engage the panel when the cage member is mounted in the opening in the panel.

In another aspect, an electrical connector assembly is provided. The electrical connector assembly includes a cage member configured for mounting in an opening in a panel. The cage member has at least one compartment for receiving a pluggable electrical component therein. An electrical connector is at least partially held by the cage member. The electrical connector is configured to electrically connect to the pluggable electrical component when the pluggable electrical component is received within the compartment. An EMI gasket is mounted externally on the cage member. The EMI gasket includes a dielectric carrier holding a plurality of electrically conductive springs that are configured to engage the panel when the cage member is mounted in the opening in the panel.

DETAILED DESCRIPTION OF THE INVENTION

Figure 1:
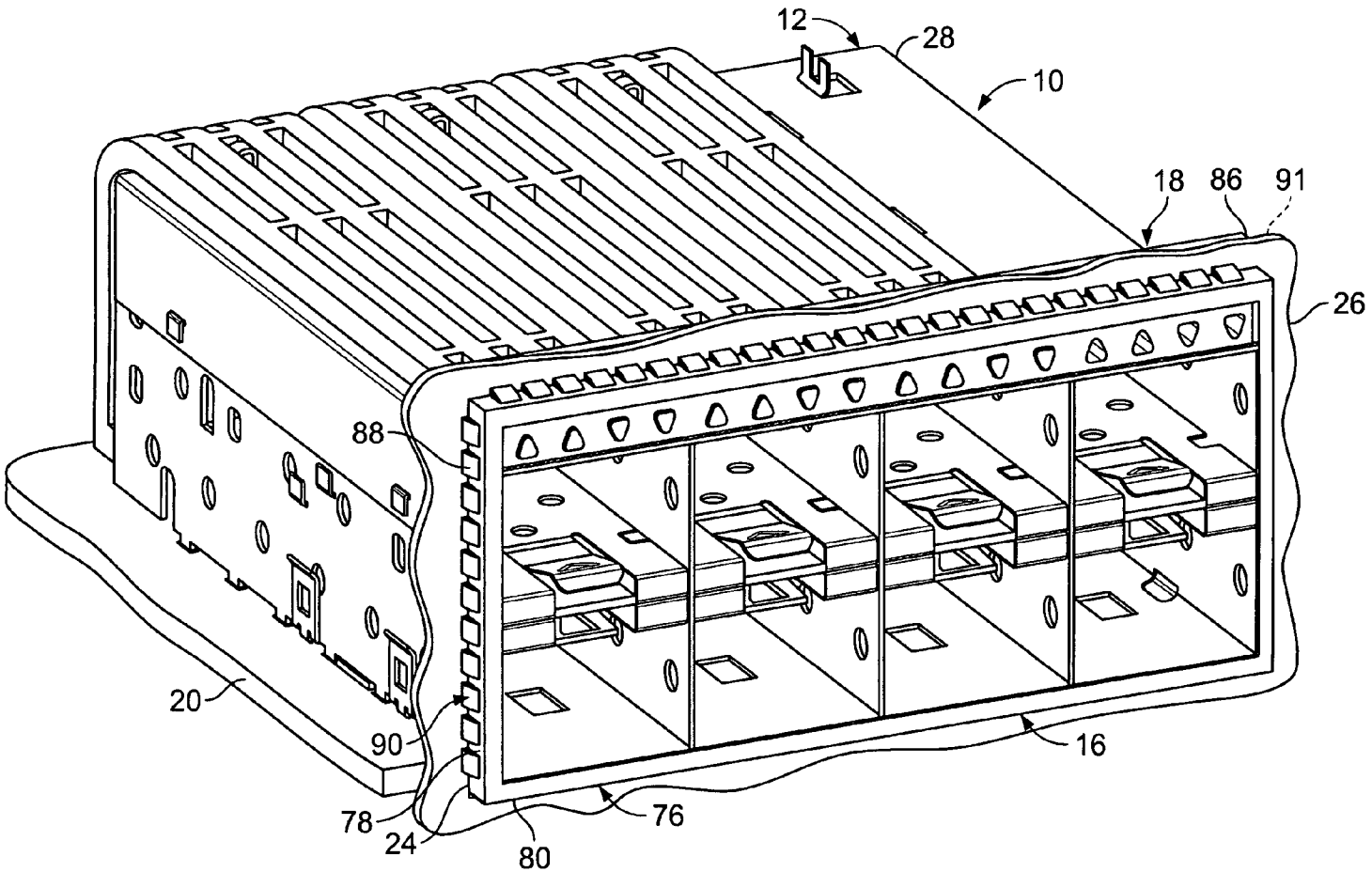
FIG. 1 is a perspective view of an electrical connector assembly formed in accordance with an embodiment of the present invention.

FIG. 1 is a perspective view of an electrical connector assembly 10 formed in accordance with an embodiment of the present invention. The assembly 10 includes a shielded cage member 12 having one or more electrical connectors 14 (FIGS. 6-8) positioned therein and an EMI gasket 16 mounted externally on an end portion 18 of the cage member 12, as will be described in more detail below. The assembly 10 is configured to be positioned on a circuit board 20 for electrically connecting one or more pluggable electrical components 22 (FIGS. 9 and 10), such as, but not limited to, small form-factor pluggable (SFP) modules, to the circuit board 20 via the electrical connector(s) 14. The end portion 18 of the cage member 12 is configured to be mounted, or received, within an opening 24 of a panel 26 that is adjacent the circuit board 20. For example, the panel 26 may be a wall of a housing of a device (not shown), such as, but not limited to, a computer, that includes the circuit board 20. In such an example, the electrical connector assembly 10 enables pluggable electrical component(s) 22 located outside the housing to be electrically connected to the circuit board 20 contained within the housing.

Figure 2:
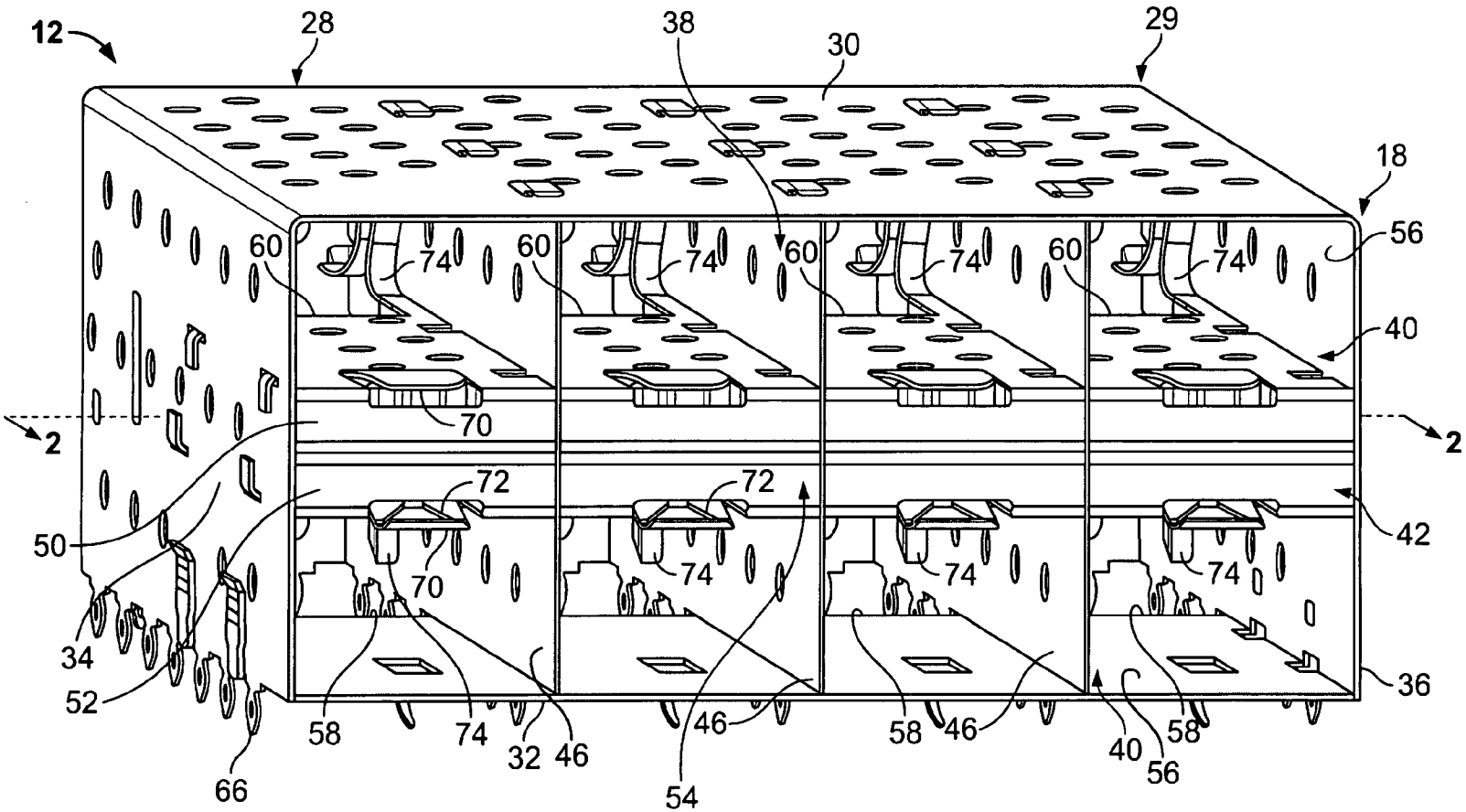
FIG. 2 is a perspective view of a cage member of the assembly shown in FIG. 1 formed in accordance with an embodiment of the present invention.
Figure 3:
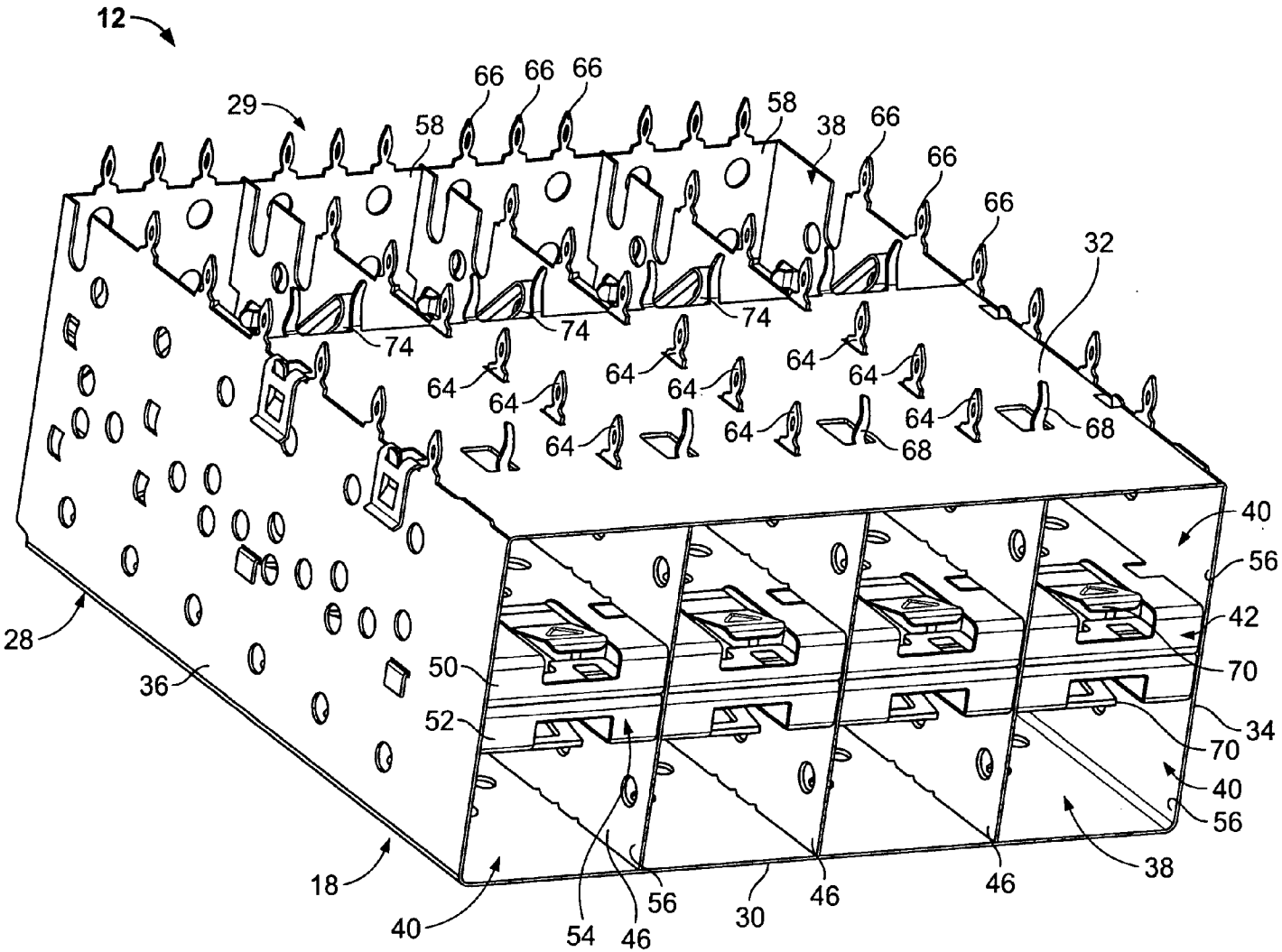
FIG. 3 is another perspective view of the cage member shown in FIG. 2.

FIGS. 2 and 3 are perspective views of the cage member 12 formed in accordance with an embodiment of the present invention. The cage member 12 includes a body 28 extending from the end portion 18 to an opposite end portion 29. In the exemplary embodiment, the cage member body 28 includes a generally rectangular cross section, for example taken along line 2-2 of FIG. 2, and includes an upper wall 30, a lower wall 32, and side walls 34 and 36. However, the cage member body 28 may include any suitable cross-sectional shape that enables the cage member 12 to function as described herein.

The cage member 12 includes an internal chamber 38 that is subdivided into a plurality of internal compartments 40, which are arranged in a plurality of rows and columns. Specifically, in the exemplary embodiment, the cage member 12 includes a center separator member 42 that divides the internal compartments 40 into two rows, and three divider walls 46 that divide the internal compartments 40 into four columns. The center separator member 42 includes an upper wall 50, a lower wall 52, and a front face portion 54. As will be discussed in more detail below, each internal compartment 40 is configured to at least partially receive a pluggable electrical component 22 (FIGS. 9 and 10) therein through a corresponding opening, or port, 56 at the cage member end portion 18 that communicates with the corresponding compartment 40. For each column of the internal compartments 40, the cage member body 28 also includes an opening 58 extending through the lower wall 32, and an opening 60 extending through the upper and lower walls 50 and 52, respectively, of the center separator member 42. The openings 58 and 60 are adjacent the end portion 29 of the cage member body 28 for at least partially receiving a corresponding electrical connector 14 (FIGS. 6-8) within the internal chamber 38 of the cage member 12, as will be described in more detail below. As will also be described in more detail below, the openings 58 within the lower wall 32 of the cage member body 28 enable electrical connection between the electrical connectors 14 and the circuit board 20 (FIG. 1).

Although the cage member 12 is shown as including eight internal compartments arranged in two rows and four columns, the cage member 12 may include any number of internal compartments 40, arranged in any number of rows and columns, for receiving any number of pluggable electrical components 22.

The cage member 12 may have features that ground the cage member 12 to the circuit board 20, the panel 26, and/or another circuit board and/or panel. For example, the cage member body 28 may include a plurality of printed circuit board tines 64 and/or 66, which may both mechanically hold and ground the cage member body 28 to the circuit board 20. Additionally or alternatively, the cage member body 28 may include one or more resilient tongues 68 extending from the lower wall 32 to provide grounding of the cage member body 28 to the circuit board 20. The upper and lower walls 50 and 52, respectively, of the central separator member 42 may include grounding tabs 70 adjacent the front face portion 54 thereof for grounding a pluggable electrical component 22 that is received within the corresponding internal compartment 40. The grounding tabs 70 may include latching openings 72, as will be described in more detail below. The cage member body 28 may include kick-out springs 74 to facilitate removing the electrical connectors 14 from the body 28.

Figure 4:
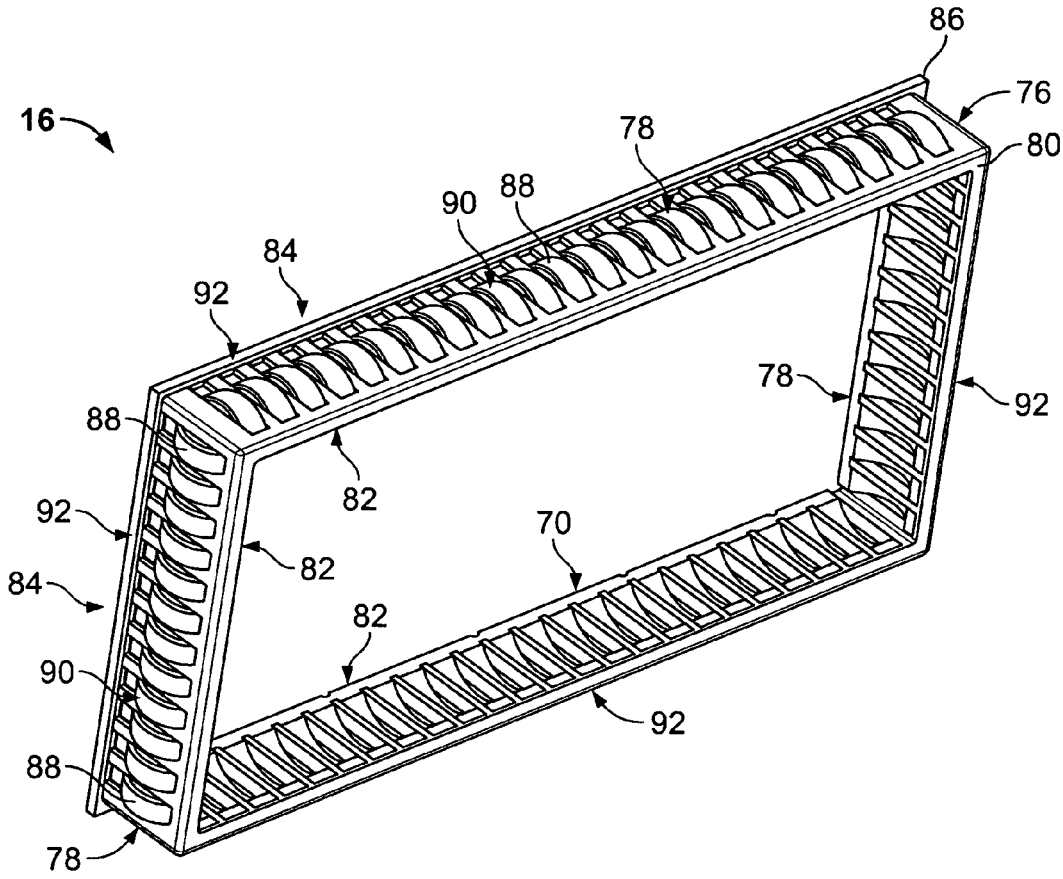
FIG. 4 is a perspective view of a gasket of the assembly shown in FIG. 1 formed in accordance with an embodiment of the present invention.

FIG. 4 is a perspective view of the EMI gasket 16 formed in accordance with an embodiment of the present invention. The gasket 16 includes a spring carrier 76 and a plurality of spring assemblies 78 mounted on and held by the spring carrier 76. In some embodiments, the spring carrier 76 is fabricated from a dielectric material, while in other embodiments the spring carrier 76 is fabricated from a an electrically conductive material. The spring carrier 76 includes a body 80 having a radially inner side 82, and a radially outer side 84 opposite the inner side 82. The body 80 may optionally include a flange 86. Each spring assembly 78 includes a plurality of individual electrically conductive springs 88. The spring assemblies 78 are held by the spring carrier 76 such that the individual springs 88 are positioned circumferentially about the gasket 16, or more specifically about the body 80 of the spring carrier 76. A spring portion 90 of each individual spring 88 extends along the outer side 84 of the body 80 for engaging a surface 91 (FIG. 1) defining the panel opening 24 (FIG. 1). The spring carrier body 80 is sized and shaped to be mounted externally on at least a portion of the end portion 18 (FIGS. 1-3) of the body 28 (FIGS. 2 and 3) of the cage member 12 (FIGS. 1-3). In the exemplary embodiment, the spring carrier body 80 is generally rectangular to generally match the rectangular cross-sectional shape of the cage member body 28. Specifically, in the exemplary embodiment, the spring carrier body 80 includes four legs 92 that are interconnected to form a rectangular shape. However, the spring carrier body 80 may include any suitable shape that enables the spring carrier 76, as well as the gasket 16 overall, to function as described herein, whether the spring carrier body 80 includes a similar shape to the cage member body 28.

The spring carrier 76 and the spring assemblies 78 may have any suitable configuration and/or arrangement, and/or may include any suitable structure and/or means, that enable the spring assemblies 78, the spring carrier, and the gasket 16 to function as described herein. Moreover, the spring assemblies 78 may be held by the spring carrier 76 in any suitable manner, configuration, arrangement, and/or orientation, and/or using any suitable structure and/or means, that enable the spring carrier 76, the spring assemblies 78, and the gasket 16 to function as described herein. One example of the two preceding sentences is the exemplary embodiment illustrated in FIGS. 4 and 5.

Figure 5:
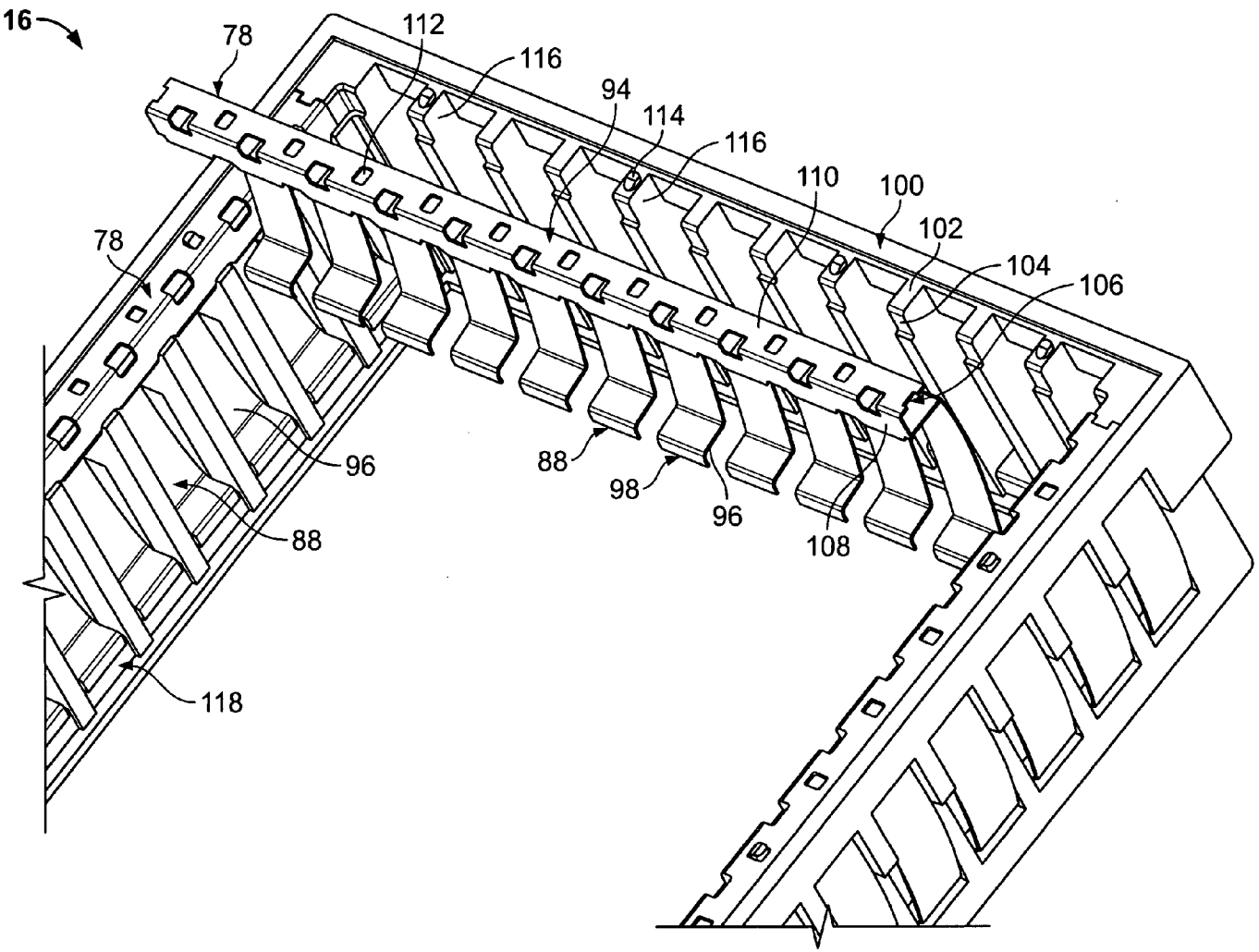
FIG. 5 is a partially exploded perspective view of a portion of the gasket shown in FIG. 4.

FIG. 5 is a partially exploded perspective view of a portion of the gasket 16. In the exemplary embodiment, each spring assembly 78 includes the plurality of individual springs 88 extending from a common base 94. The individual springs 88 each include a body 96 extending from the base 94 to a free end portion 98. The individual springs 88 may be integrally formed with the base 94, or may be fabricated separately from the base 94 and thereafter connected thereto. The use of the term "assembly" herein includes a structure wherein each component of the structure is integrally formed, and a structure wherein some or all components of the structure are separately fabricated and thereafter connected to each other or other components of the structure.

The base 94 engages the cage member body 28 to provide an electrical connection between the individual springs 88 and the cage member 12. The base 94 connects to an end portion 100 of the spring carrier body 80 where a surface 102 of the body 80 intersects a radially inner surface 104 of the radially inner side 82 of the body 80. Specifically, the base 94 defines a channel 106 that overlaps the end portion 100 such that a wall 108 of the channel 106 engages the radially inner surface 104 of the spring carrier body 80, and such that a wall 110 of the channel 106 engages the surface 102 of the body 80. The base 94 may be secured to the end portion 100 in any suitable manner, configuration, and/or arrangement, and/or using any suitable structure and/or means, that enables the gasket 16 to function as described herein. For example, in the exemplary embodiment, the channel wall 110 includes a plurality of openings 112 that each receives an extension 114 that extends outwardly from the surface 102 of the spring carrier body 80. The channel wall 110 may include any number of openings 112 that each receives any number of extensions 114. In addition or alternative to the openings 112/extensions 114, another example includes a snap-fit arrangement, wherein the channel 106 is provided with a size and/or shape such that the channel walls 108 and/or 110 are deformed and/or displaced when the channel 106 overlaps the end portion 100 of the spring carrier body 80. In such a snap-fit arrangement, the channel 106 forms a spring portion of the spring assembly 78 that engages, or overlaps, the end portion 100 of the spring carrier body 80. The channel 106, or spring portion, holds the base 94 on the end portion 100 via the bias of the spring portion to return to its non-deformed and/or non-displaced size and/or shape.

The body 80 of the spring carrier 76 includes a plurality of slots 116 for receiving the individual spring bodies 96 when the base 94 is connected to the spring carrier body 80. In the exemplary embodiment, each slot 116 receives one individual spring 88 therein, however one or more slots 116 may alternatively each receive two or more individual springs 88 therein. The spring carrier body 80 may include any number of slots 116 for receiving any number of individual springs 88. The individual spring bodies 96 extend within the slots 116 such that the free end portions 98 engage an end portion 118 of the spring carrier body 80 that is opposite the end portion 100. A portion of each of the slots 116 extends completely through the spring carrier body 80 such that when the individual springs 88 are received within the slots 116, the radially outer side 84 of the spring carrier body 80 includes the spring portions 90 of the individual springs 88 extending along the side 84, and such that the radially inner side 82 of the spring carrier body 80 includes other portions of the individual springs 88 (e.g., at least a portion of the free end portions 98 and the channel wall 108). Although the individual spring bodies 96 are described and illustrated in the exemplary embodiment as having a length extending in a direction generally perpendicular to the length of the legs 92 of the spring carrier body 80, the spring carrier body 80 and/or the spring assemblies 78 may be configured such that the individual spring bodies 96 extend in any other direction relative to the length of the legs 92 when the spring assemblies 78 are held by the spring carrier 76, such as a direction generally parallel or generally oblique relative to the length of the legs 92.

Although each spring assembly 78 is described and illustrated herein in the exemplary embodiment as including a plurality of individual springs 88, each spring assembly 78, and/or the gasket 16 overall, may include any number of individual springs, including only one individual spring. Similarly, although the spring carrier 76 is described and illustrated herein in the exemplary embodiment as including four spring assemblies 78 (one for each leg 92 of the spring carrier body 80), the spring carrier 76 may hold any number of spring assemblies 78, including only one spring assembly 78. For example, one or more legs 92 of the spring carrier body 80 may not hold a spring assembly 78, one or more legs 92 of the spring carrier body 80 may hold more than one spring assembly 78, and/or a plurality of the legs 92 of the spring carrier body 80 may hold a common spring assembly 78 (e.g., two or more of the legs 92 are connected to a common base 94 as described and illustrated with respect to FIG. 5). Moreover, although at least a majority of the circumference of the spring carrier 76 is described and illustrated herein in the exemplary embodiment as including individual springs 88 positioned thereabout, some portions of the circumference of the spring carrier 76 may alternatively not include springs 88 positioned thereabout. For example, one or more legs 92 of the spring carrier body 80 may not hold a spring assembly 78 (as described above), and/or one or more legs 92 of the spring carrier body 80 may hold one or more spring assemblies 78 along only a portion of a length of the leg 92. In contrast to the exemplary embodiment, one or more spring assemblies 78 may be formed integrally with the spring carrier body 80.

Referring now to FIG. 1, when the spring carrier body 80 is received on the cage member end portion 18, the spring carrier body 80, and thus the gasket 16, surrounds at least a portion of the cage member end portion 18. Although shown as generally completely surrounding the cage member end portion 18 in the exemplary embodiment, the gasket 16 may alternatively surround only a portion of the cage member end portion 18. The gasket 16 may be held on the end portion 18 using any suitable structure and/or means, such as, but not limited to, adhesive (not shown), frictional engagement, one or more latching mechanisms (not shown), and/or one or more extensions (on the cage member body 28, the spring carrier 76, and/or one or more of the spring assemblies 78) (not shown) received within one or more openings (within the cage member body 28, the spring carrier 76, and/or one or more of the spring assemblies 78) (not shown).

When the cage member end portion 18 is received within the panel opening 24, the spring portion 90 of each individual spring 88 engages the surface 91 defining the panel opening 24. If included, the gasket flange 86 may limit how much of the cage member end portion 18 extends through the panel opening 24. The engagement between the spring portions 90 and the panel opening surface 91 facilitates containing electromagnetic interference (EMI) emissions by providing a plurality of contact points that ground the cage member 12 to the panel 26. The engagement between the spring portions 90 and the panel opening surface 91 also facilitates securely holding the cage member end portion 18 within the panel opening 24. Specifically, as the cage member end portion 18 is received within the panel opening 24, the panel opening surface 91 displaces and/or deforms the spring portions 90 generally radially inwardly against their bias, which exerts a spring force on the panel opening surface 91 to securely hold the cage member end portion 19 within the panel opening 24. The spring assemblies 78 may be held within the spring carrier 76 such that the spring portions 90 are non-deformed and/or non-displaced from their natural size and/or shape when the cage member end portion 18 is not received within the panel opening 24. In such an embodiment, the panel opening surface 91 displaces and/or deforms the spring portions 90 from their natural size and/or shape as the cage member end portion 18 is received within the panel opening 24. In such an embodiment, a size, shape, and/or material of the spring portions 90 may be selected to provide a predetermined spring force.

Alternatively, the spring assemblies 78 may be held within the spring carrier 76 such that the spring portions 90 are initially deformed and/or displaced from their natural size and/or shape when the cage member end portion 18 is not received within the panel opening 24. For example, the spring portions 90 may be deformed and/or displaced such that they have an increased curvature from their natural size and/or shape. In such an embodiment, as the cage member end portion 18 is received within the panel opening 24, the panel opening surface 91 displaces and/or deforms the spring portions 90 generally radially inwardly against the bias of their initially deformed and/or displaced size and/or shape. In such an embodiment, in addition or alternative to a size, shape, and/or material of the spring portions 90, a length of the slots 116 may be selected to provide the spring portions 90 with an initial deformation and/or displacement that provides a predetermined spring force.

Figure 6:
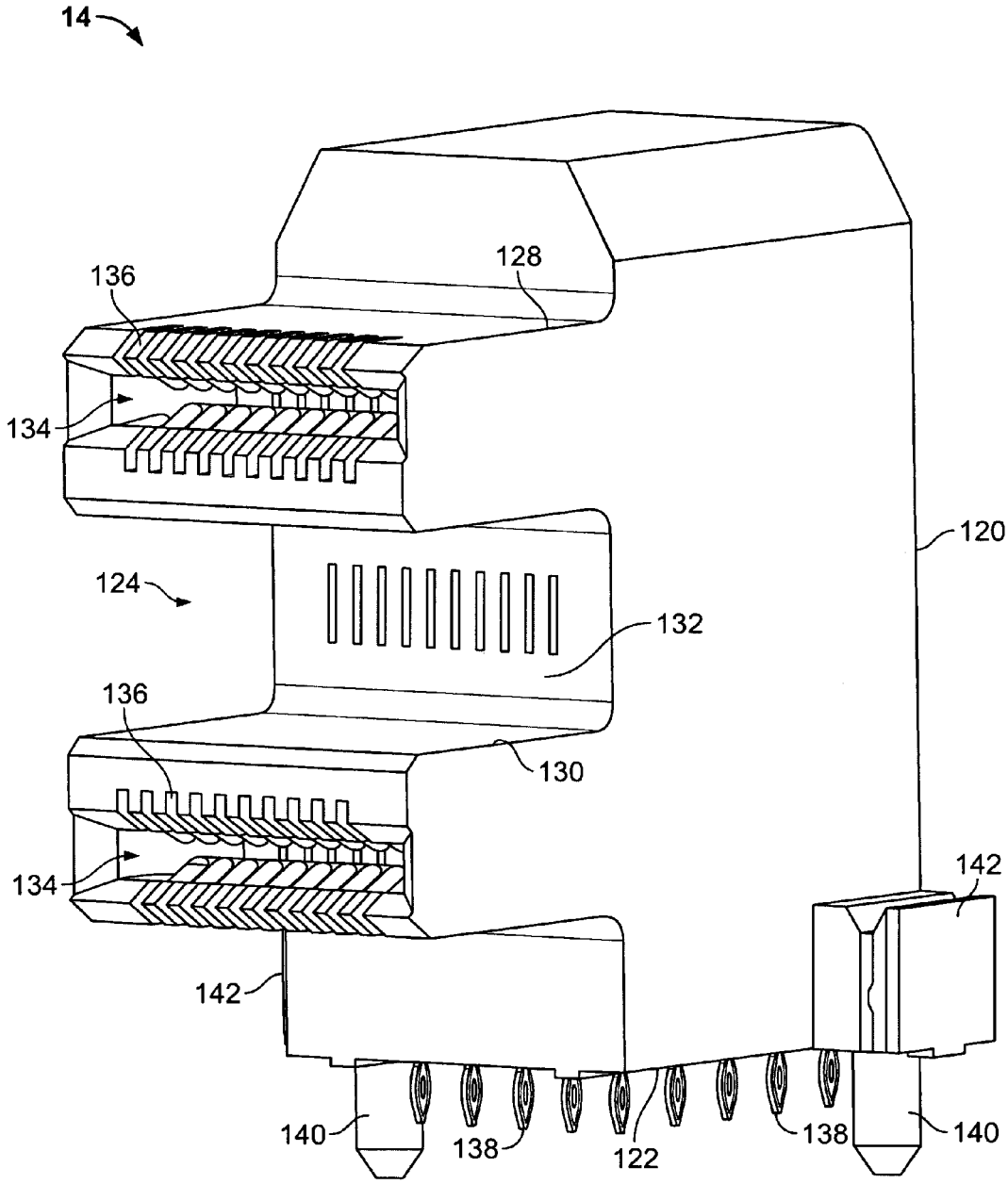
FIG. 6 is a perspective view of an electrical connector of the assembly shown in FIG. 1 formed in accordance with an embodiment of the present invention.

FIG. 6 is a perspective view of an electrical connector 14 formed in accordance with an embodiment of the present invention. The electrical connector 14 includes a housing 120 having a lower face 122 for mating with the circuit board 20 (FIG. 1) and a mating face 124 for reception of a plug portion 126 (FIGS. 9 and 10) of the pluggable electrical component 22. Specifically, the mating face 124 includes an upper extension receptacle 128 and a lower extension receptacle 130 that each extend outwardly from a recessed surface 132 extending therebetween. The upper and lower extension receptacles 128 and 130, respectively, each include a terminal receptacle 134 that receives the plug portion 126 of the corresponding pluggable electrical component 22 therein. The terminal receptacles 134 each include one or more electrical contacts 136 that are electrically connected to corresponding electrical contacts 138 extending along the lower face 122 of the housing 120, such as, but not limited to, using electrical contacts (not shown) and/or circuit board traces (not shown) held within the housing 120. The electrical contacts 136 and 138 may each be any suitable type of electrical contact. The housing 120 may include alignment posts 140 and latching members 142 for aligning the electrical connector 14 within the cage member 12 (FIGS. 1-3) and latching the electrical connector 14 in place within the cage member 12, respectively.

Figure 7:
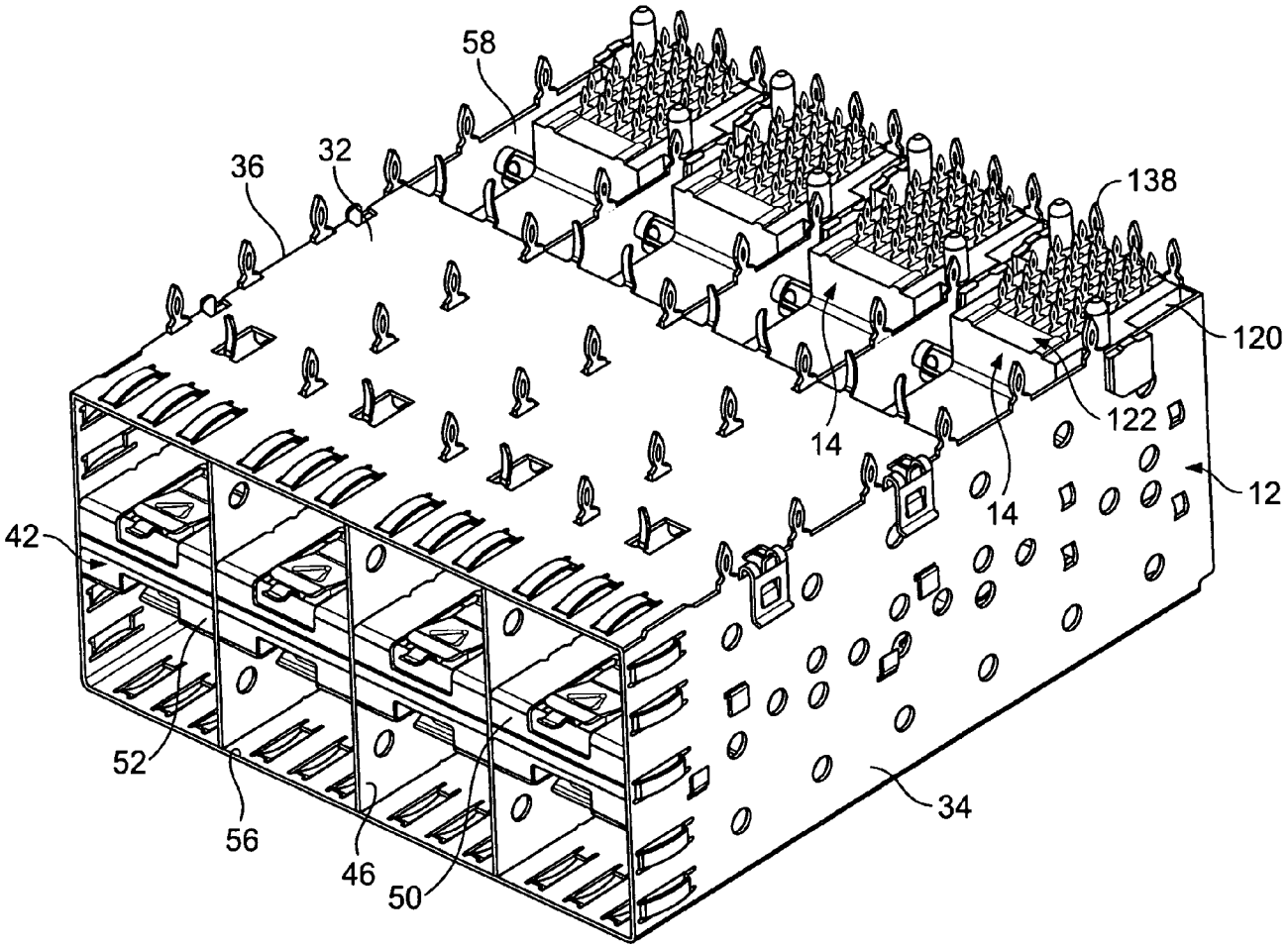
FIG. 7 is a perspective view of the cage member shown in FIGS. 2 and 3 holding a plurality of the electrical connectors shown in FIG. 6.
Figure 8:
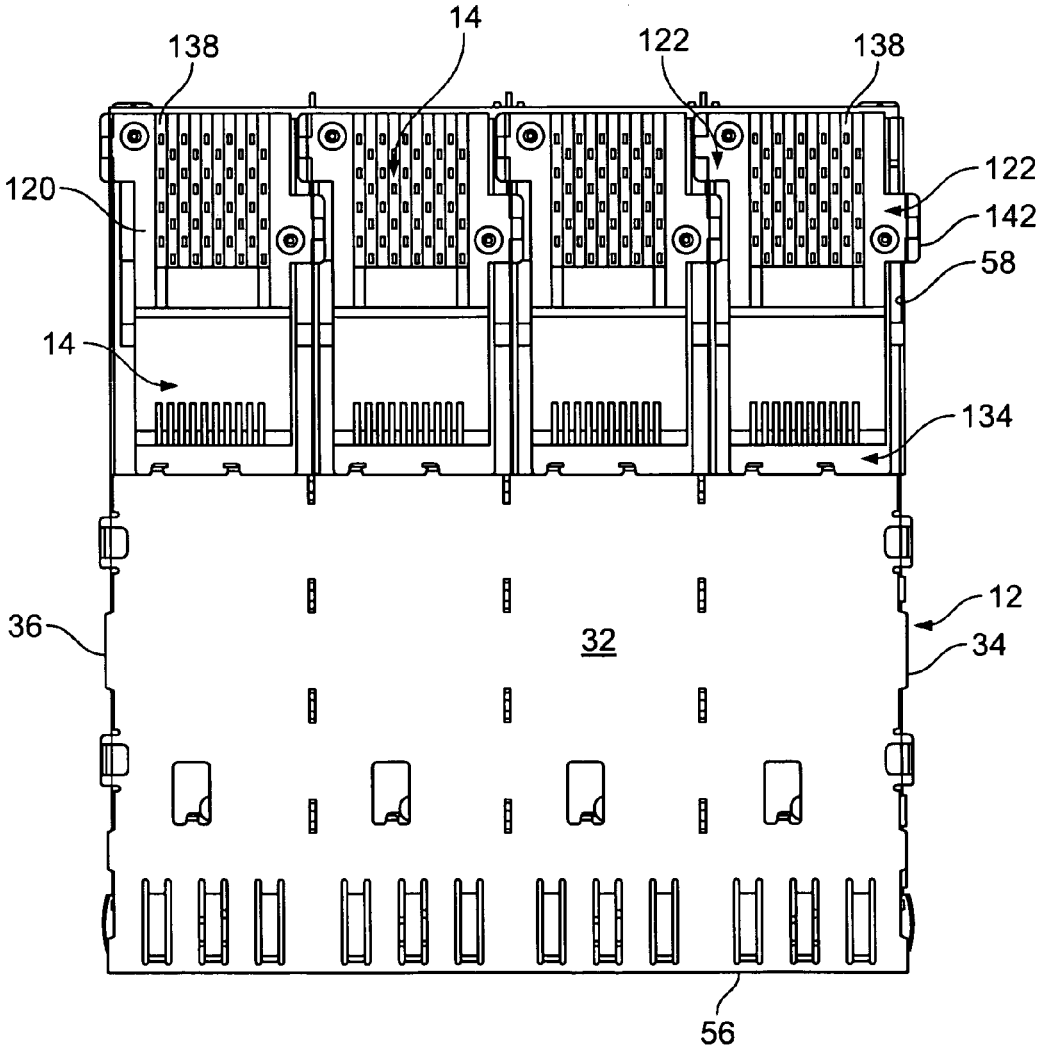
FIG. 8 is a bottom plan view of the cage member and electrical connectors shown in FIG. 7.

The electrical connector 14 can be positioned within the cage member 12 by inserting the connector 14 through the openings 58 and 60 (FIGS. 2 and 3) within the lower wall 32, the lower wall 52 of the center separator member 42, and the upper wall 50 of the center separator member 42, respectively, to the position shown in FIGS. 7 and 8. In such a position, the lower face 122 of the housing 120 extends adjacent the opening 58 within the lower wall 32 of the cage member 12 such that the electrical contacts 138 extend through the opening 58. When the cage member 12 is positioned on the circuit board 20, the lower face 122 of the housing 120 engages the circuit board 20 such that the electrical contacts 138 extending along the lower face 122 of the housing 120 are electrically connected to the circuit board 20. Each of the electrical connectors 14 is shown latched to the cage member 12, whereby the latches 142 are latched to either a side wall 34 or 36 or a divider wall 46. When the electrical connectors 14 are latched in place within the cage member 12, the terminal receptacles 134 are aligned with the corresponding internal compartment openings 56 for receipt of the plug portion 126 of the corresponding pluggable electrical component 22.

Figure 9:
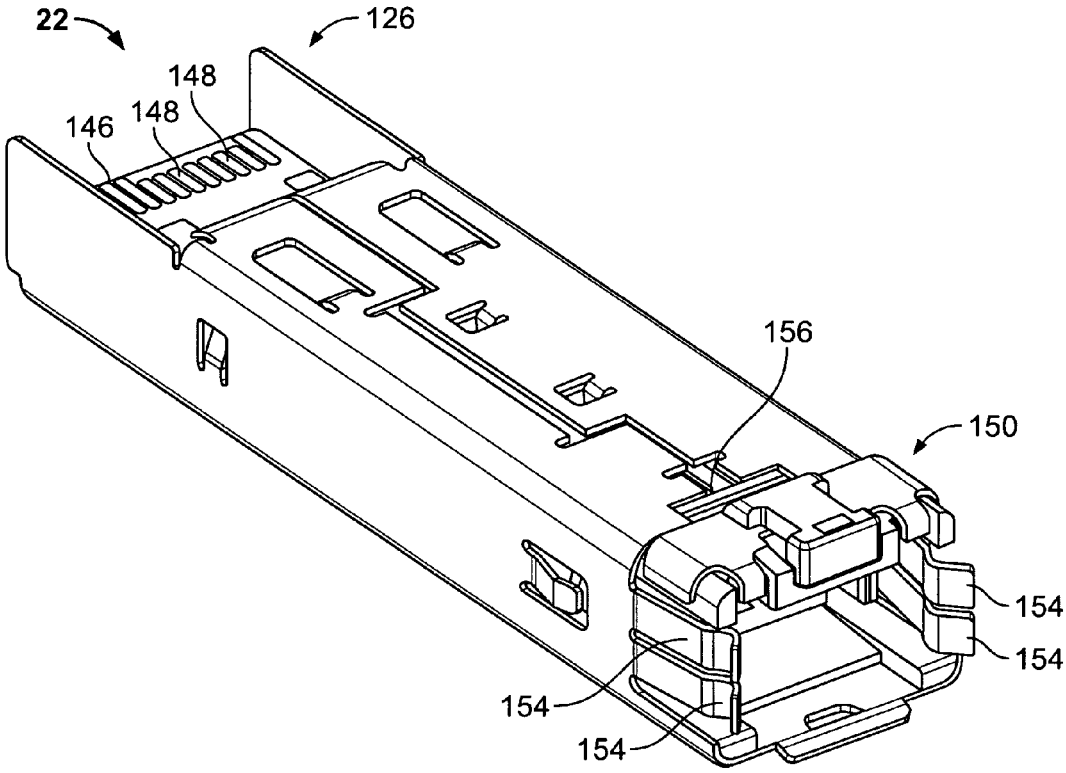
FIG. 9 is a perspective view a pluggable electrical component for the assembly shown in FIG. 1 formed in accordance with an embodiment of the present invention.
Figure 10:
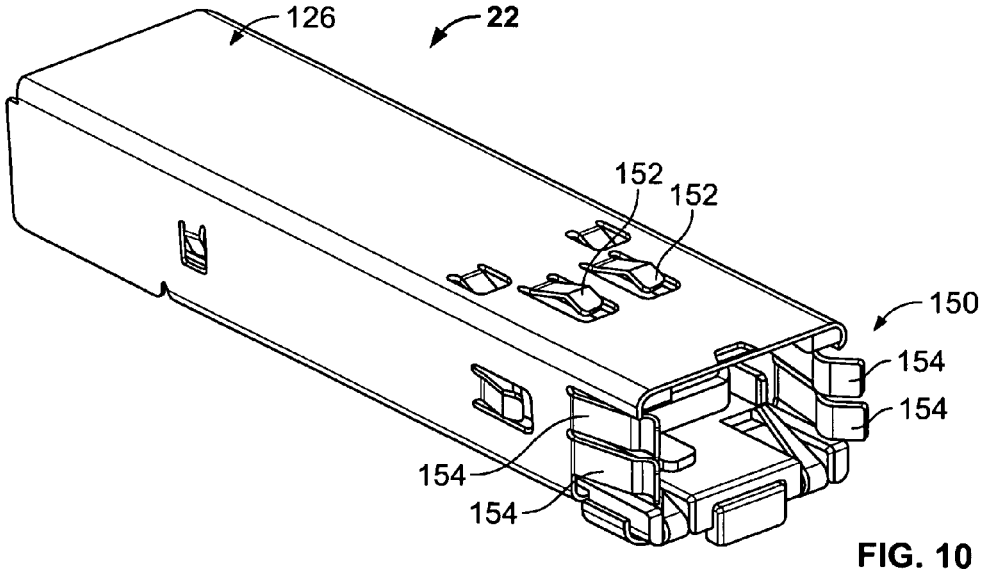
FIG. 10 is another perspective view of the pluggable electrical component shown in FIG. 9.

FIG. 9 is a perspective view of a pluggable electrical component 22 formed in accordance with an embodiment of the present invention. FIG. 10 is another perspective view of the pluggable electrical component 22. Although illustrated as a small form-factor pluggable (SFP) module, any suitable type of pluggable electrical component may be used with embodiments of the invention. The pluggable electrical component 22 includes the plug portion 126 for reception into the corresponding terminal receptacle 134 (FIG. 6) of the corresponding electrical connector 14 (FIGS. 6-8). In the exemplary embodiment, the plug portion 126 includes a circuit board 146 that is received within the corresponding terminal receptacle 134 such that electrical contacts 148 held on the circuit board 146 are electrically connected to the corresponding electrical contacts 136 of the corresponding terminal receptacle 134. As such, the pluggable electrical component 22 can be electrically connected to the circuit board 20 (FIG. 1) via the corresponding electrical connector 14 held within the cage member 12 (FIGS. 1-3). The electrical contacts 148 may each be any suitable type of electrical contact.

The pluggable electrical component 22 also includes an electrical interconnection to an interface (not shown) at an end portion 150 that is opposite the plug portion 126, such as, but not limited to, a copper interface in the way of a modular jack (not shown), or to a fiber optic connector (not shown) for further interfacing. The pluggable electrical component 22 may include grounding tabs 152 and/or 154 for grounding the pluggable electrical component 22 to the cage member 12. A raised embossment 156 may also be provided for cooperation with the latching openings 72 (FIGS. 2 and 3) of the cage member 12 to facilitate latching the pluggable electrical component 22 in place within the cage member 12.

The embodiments described and illustrated herein provide an electrical connector assembly that includes a cage member that facilitates minimizing EMI emissions while maintaining a structural integrity that is within design limits.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc.

While the invention has been described in terms of various specific embodiments, those skilled in the art will recognize that the invention can be practiced with modification within the spirit and scope of the claims.

What is claimed is:

1. An electrical connector assembly comprising:

a cage member configured for mounting in an opening in a panel, the cage member having at least one compartment for receiving a pluggable electrical component therein; and an EMI gasket mounted externally on the cage member, the EMI gasket including a dielectric carrier holding a plurality of electrically conductive springs that are configured to engage the panel when the cage member is mounted in the opening in the panel, the plurality of electrically conductive springs each extending from a common electrically conductive base, wherein the common electrically conductive base comprises an opening, and the dielectric carrier comprises an extension extending outwardly from a surface thereof, the extension being received within the opening for holding the common electrically conductive base on the dielectric carrier.

2. The electrical connector assembly according to claim 1, wherein the common electrically conductive base engages the cage member.

3. The electrical connector assembly according to claim 1, wherein the plurality of electrically conductive springs are positioned circumferentially about the dielectric carrier.

4. An electrical connector assembly comprising:

a cage member configured for mounting in an opening in a panel, the cage member having at least one compartment for receiving a pluggable electrical component therein; and an EMI gasket mounted externally on the cage member, the EMI gasket including a dielectric carrier holding a plurality of electrically conductive springs that are configured to engage the panel when the cage member is mounted in the opening in the panel, wherein each electrically conductive spring comprises a first spring portion and a second spring portion, the first spring portion for engaging the panel when the cage member is mounted in the opening in the panel, the second spring portion engaging the dielectric carrier for holding the spring on the dielectric carrier via the bias of the second spring portion.

5. An electrical connector assembly comprising:

a cage member configured for mounting in an opening in a panel, the cage member having at least one compartment for receiving a pluggable electrical component therein; and an EMI gasket mounted externally on the cage member, the EMI gasket including a dielectric carrier holding a plurality of electrically conductive springs that are configured to engage the panel when the cage member is mounted in the opening in the panel, wherein the dielectric carrier comprises a plurality of slots, and each electrically conductive spring is received within a corresponding slot of the plurality of slots.

6. The electrical connector assembly according to claim 5, wherein each slot of the plurality of slots extends completely through the dielectric carrier, a radially outer side of the gasket comprises a first portion of each of the electrically conductive springs, and a radially inner side of the gasket opposite the radially outer side comprises a second portion of each of the electrically conductive springs.

7. The electrical connector assembly according to claim 5, wherein the dielectric carrier comprises a generally rectangular shape, and the cage member comprises a generally rectangular cross section.

8. The electrical connector assembly according to claim 5, wherein the cage member is shielded.

9. The electrical connector assembly according to claim 5, wherein the plurality of conductive springs are each electrically connected to the cage member.

10. An electrical connector assembly comprising:

a cage member configured for mounting in an opening in a panel, the cage member having at least one compartment for receiving a pluggable electrical component therein;

an electrical connector at least partially held by the cage member, the electrical connector configured to electrically connect to the pluggable electrical component when the pluggable electrical component is received within the compartment; and an EMI gasket mounted externally on the cage member, the EMI gasket including a dielectric carrier holding a plurality of electrically conductive springs that are configured to engage the panel when the cage member is mounted in the opening in the panel, the plurality of electrically conductive springs each extending from a common electrically conductive base, wherein the common electrically conductive base comprises an opening, and the dielectric carrier comprises an extension extending outwardly from a surface thereof, the extension being received within the opening for holding the common electrically conductive base on the dielectric carrier.

11. The electrical connector assembly according to claim 10, wherein the common electrically conductive base engages the cage member.

12. The electrical connector assembly according to claim 10, wherein the plurality of electrically conductive springs are positioned circumferentially about the dielectric carrier.

13. The electrical connector assembly according to claim 10, wherein each electrically conductive spring comprises a first spring portion and a second spring portion, the first spring portion for engaging the panel when the cage member is mounted in the opening in the panel, the second spring portion engaging the dielectric carrier for holding the spring on the dielectric carrier via the bias of the second spring portion.

14. The electrical connector assembly according to claim 10, wherein the dielectric carrier comprises a generally rectangular shape, and the cage member comprises a generally rectangular cross section.

15. The electrical connector assembly according to claim 10, wherein the dielectric carrier comprises a plurality of slots, and each electrically conductive spring is received within a corresponding slot of the plurality of slots.

16. The electrical connector assembly according to claim 15, wherein each slot of the plurality of slots extends completely through the dielectric carrier, a radially outer side of the gasket comprises a first portion of each of the electrically conductive springs, and a radially inner side of the gasket opposite the radially outer side comprises a second portion of each of the electrically conductive springs.

* * * * *